US010274283B1

(12) United States Patent
Oglesby

(10) Patent No.: US 10,274,283 B1
(45) Date of Patent: Apr. 30, 2019

(54) HANDGUARD EXTENSION COMPONENT

(71) Applicant: Paul Oglesby, Darley (GB)

(72) Inventor: Paul Oglesby, Darley (GB)

( * ) Notice: Subject to any disclaimer, the term of this patent is extended or adjusted under 35 U.S.C. 154(b) by 989 days.

(21) Appl. No.: 14/709,134

(22) Filed: May 11, 2015

Related U.S. Application Data

(60) Provisional application No. 61/991,401, filed on May 9, 2014.

(51) Int. Cl.
*F41C 23/16* (2006.01)

(52) U.S. Cl.
CPC ..... *F41C 23/16* (2013.01)

(58) Field of Classification Search
USPC ..... 42/71.01
See application file for complete search history.

(56) References Cited

U.S. PATENT DOCUMENTS 5,343,650 A * 9/1994 Swan ..... F41C 23/16 42/117
6,490,822 B1 * 12/2002 Swan ..... F41C 23/00 42/124
6,499,245 B1 * 12/2002 Swan ..... F41C 23/00 42/124
6,671,990 B1 * 1/2004 Booth ..... F41C 23/16 42/75.01
7,059,076 B2 * 6/2006 Stoner ..... F41G 11/003 42/75.01
7,216,451 B1 * 5/2007 Troy ..... F41C 23/16 42/71.01
7,707,762 B1 * 5/2010 Swan ..... F41G 11/003 42/105
7,793,452 B1 * 9/2010 Samson ..... F41C 23/16 42/71.01
7,905,041 B1 * 3/2011 Davies ..... F41A 3/66 42/75.02
7,941,959 B1 * 5/2011 Swan ..... F41G 11/003 42/105
8,087,194 B1 * 1/2012 Vuksanovich ..... F41A 21/48 42/75.01
8,141,285 B2 * 3/2012 Brown ..... F41A 3/66 42/71.01
8,230,634 B1 * 7/2012 Davies ..... F41A 3/66 42/75.02

(Continued)

*Primary Examiner* — Michelle Clement
(74) *Attorney, Agent, or Firm* — Shaddock Law Group, PC

(57) ABSTRACT

A handguard extension system having a handguard, wherein at least one handguard extension receiving channel is formed in a portion of the handguard, wherein at least one alignment/retention slot is formed at least partially through the handguard extension receiving channel so as to at least partially receive a portion of an attachment screw therethrough; and a handguard extension component comprising an attachment portion and an extension portion, wherein the attachment portion is sized so as to be at least partially received within at least a portion of the handguard extension receiving channel, wherein at least one aperture is formed through the attachment portion, wherein the at least one aperture is positioned so as to correspond to one or more of the alignment/retention slots, thereby allowing the attachment screw to secure at least a portion of the attachment portion within handguard extension receiving channel.

20 Claims, 10 Drawing Sheets

(56) References Cited

U.S. PATENT DOCUMENTS 8,347,540 B2 * 1/2013 Sirois ..... F41C 23/16 42/71.01
8,689,478 B2 * 4/2014 Patel ..... F41A 3/66 42/75.02
8,726,557 B2 * 5/2014 Stone ..... F41C 23/16 42/71.01
8,726,558 B1 * 5/2014 Nason ..... F41C 23/16 42/71.01
8,739,448 B2 * 6/2014 Kimmel ..... F41C 23/16 42/124
8,789,304 B2 * 7/2014 Engesser ..... F41A 21/481 42/75.01
8,850,735 B2 * 10/2014 Kenney ..... F41A 3/66 42/106
8,863,426 B1 * 10/2014 Zinsner ..... F41C 23/16 42/71.01
8,904,691 B1 * 12/2014 Kincel ..... F41C 23/16 42/71.01
9,134,082 B2 * 9/2015 Brown ..... F41A 5/18
9,140,506 B2 * 9/2015 Gomez ..... F41A 21/487
9,157,696 B2 * 10/2015 Dextraze ..... F41G 11/003
2007/0006509 A1 * 1/2007 DeSomma ..... F41G 11/003 42/72
2007/0261285 A1 * 11/2007 Troy ..... F41C 23/16 42/75.03
2010/0186278 A1 * 7/2010 Daniel ..... F41C 23/16 42/71.01
2010/0319231 A1 * 12/2010 Stone ..... F41C 23/16 42/71.01
2011/0000119 A1 * 1/2011 Desomma ..... F41A 3/66 42/75.02
2011/0016762 A1 * 1/2011 Davies ..... F41A 21/487 42/75.01
2011/0061281 A1 * 3/2011 Kapusta ..... F41C 23/16 42/71.01
2011/0126443 A1 * 6/2011 Sirois ..... F41C 23/16 42/90
2011/0192066 A1 * 8/2011 Kimmel ..... F41C 23/16 42/71.01
2011/0214327 A1 * 9/2011 Desomma ..... F41A 3/66 42/75.02
2011/0239513 A1 * 10/2011 Sandman ..... F41C 23/16 42/90
2012/0042557 A1 * 2/2012 Gomez ..... F41C 23/16 42/90
2012/0111183 A1 * 5/2012 Hochstrate ..... F41A 5/18 89/193
2012/0117845 A1 * 5/2012 Desomma ..... F41A 3/66 42/75.02
2012/0131838 A1 * 5/2012 Edge ..... F41G 11/006 42/90
2012/0216439 A1 * 8/2012 Barrett ..... F41A 3/26 42/75.02
2012/0317859 A1 * 12/2012 Brown ..... F41A 3/66 42/71.01
2014/0047755 A1 * 2/2014 McClintock ..... F41C 27/00 42/90
2014/0068987 A1 * 3/2014 Burt ..... F41C 23/16 42/16
2014/0373419 A1 * 12/2014 Leclair ..... F41C 23/16 42/71.01
2015/0007476 A1 * 1/2015 Dextraze ..... F41G 11/003 42/71.01
2015/0135572 A1 * 5/2015 Davies ..... F41C 23/16 42/71.01
2015/0168095 A1 * 6/2015 Dubreuil ..... F41C 23/16 42/90

* cited by examiner

HANDGUARD EXTENSION COMPONENT

CROSS-REFERENCE TO RELATED APPLICATIONS

This patent application claims the benefit of U.S. Patent Application Ser. No. 61/991,401, filed May 9, 2014, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearm handguards. More specifically, the present disclosure relates to a handguard extension component.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

One of the reasons for widespread popularity and usage of the AR-15 is its modularity. One feature that contributes to the modularity of the AR-15 is the ability to utilize a variety of handguards, some incorporating accessory rails, such as, for example, a Picatinny rail.

The Picatinny rail is a generally wedge shaped, or dovetailed feature used on some firearms, tools, or other devices in order to provide a standardized accessory mounting platform. The standard for the Picatinny rail was first published by the Picatinny Arsenal in 1913, and thus carries the official U.S. Government designation MIL-STD-1913.

The interchangeability of accessories is of particular importance to military and law enforcement personnel attached to special operations units, as this allows a single firearm to be reconfigured to meet certain mission specific needs.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, the amount of accessory rail space present on a given hand guard can be limiting.

In various exemplary, non-limiting embodiments, the handguard extension component of the present disclosure comprises a removable handguard extension component that slides into a handguard extension receiving channel of the handguard rail and is retained with one or more attachment or locking screws. The handguard extension component can be provided different lengths and heights of rail segment to allow accessories to be mounted or attached to the handguard extension component.

In various exemplary, non-limiting embodiments, the handguard extension component of the present disclosure comprises a handguard extending along a longitudinal axis, from a first end to a second end, wherein a handguard aperture extends through at least a portion of the handguard, wherein at least one handguard extension receiving channel is formed in a portion of the handguard, wherein at least one alignment/retention slot is formed at least partially through at least one side of the handguard extension receiving channel so as to at least partially receive a portion of an attachment screw therethrough; and a handguard extension component comprising an attachment portion and an extension portion, wherein the extension portion extends from the attachment portion, wherein the attachment portion is sized so as to be at least partially received within at least a portion of the handguard extension receiving channel, wherein at least one aperture is formed through the attachment portion, wherein the at least one aperture is positioned so as to correspond to one or more of the alignment/retention slots, thereby allowing at least a portion of the attachment screw to be aligned with and passed through the aligned aperture and alignment/retention slot to secure at least a portion of the attachment portion within handguard extension receiving channel.

Accordingly, the presently disclosed system provides a handguard extension component that allows a user to readily install or remove a handguard extension component from a handguard a firearm.

The presently disclosed invention separately provides a handguard accessory rail extending component that provides additional attachment space to a handguard.

The presently disclosed invention separately provides a handguard accessory rail extending component that can be easily installed and/or removed by a user.

These and other aspects, features, and advantages of the present system are described in or are apparent from the following detailed description of the exemplary, non-limiting embodiments of the present system and the accompanying figures. Other aspects and features of embodiments of the present system will become apparent to those of ordinary skill in the art upon reviewing the following description of specific, exemplary embodiments of the present system in concert with the figures.

While features of the disclosed system may be discussed relative to certain embodiments and figures, all embodiments of the disclosed system can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the disclosed system.

Any benefits, advantages, or solutions to problems that are described herein with regard to specific embodiments are not intended to be construed as a critical, required, or essential feature(s) or element(s) of the disclosed system or the claims.

BRIEF DESCRIPTION OF THE SEVERAL VIEWS OF THE DRAWINGS

As required, detailed exemplary embodiments of the disclosed system are disclosed herein; however, it is to be understood that the disclosed embodiments are merely exemplary of the invention that may be embodied in various and alternative forms, within the scope of the disclosed system. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the disclosed system.

The exemplary embodiments of this invention will be described in detail, with reference to the following figures, wherein like reference numerals refer to like parts throughout the several views, and wherein.

DETAILED DESCRIPTION OF THE INVENTION

Figure 1:
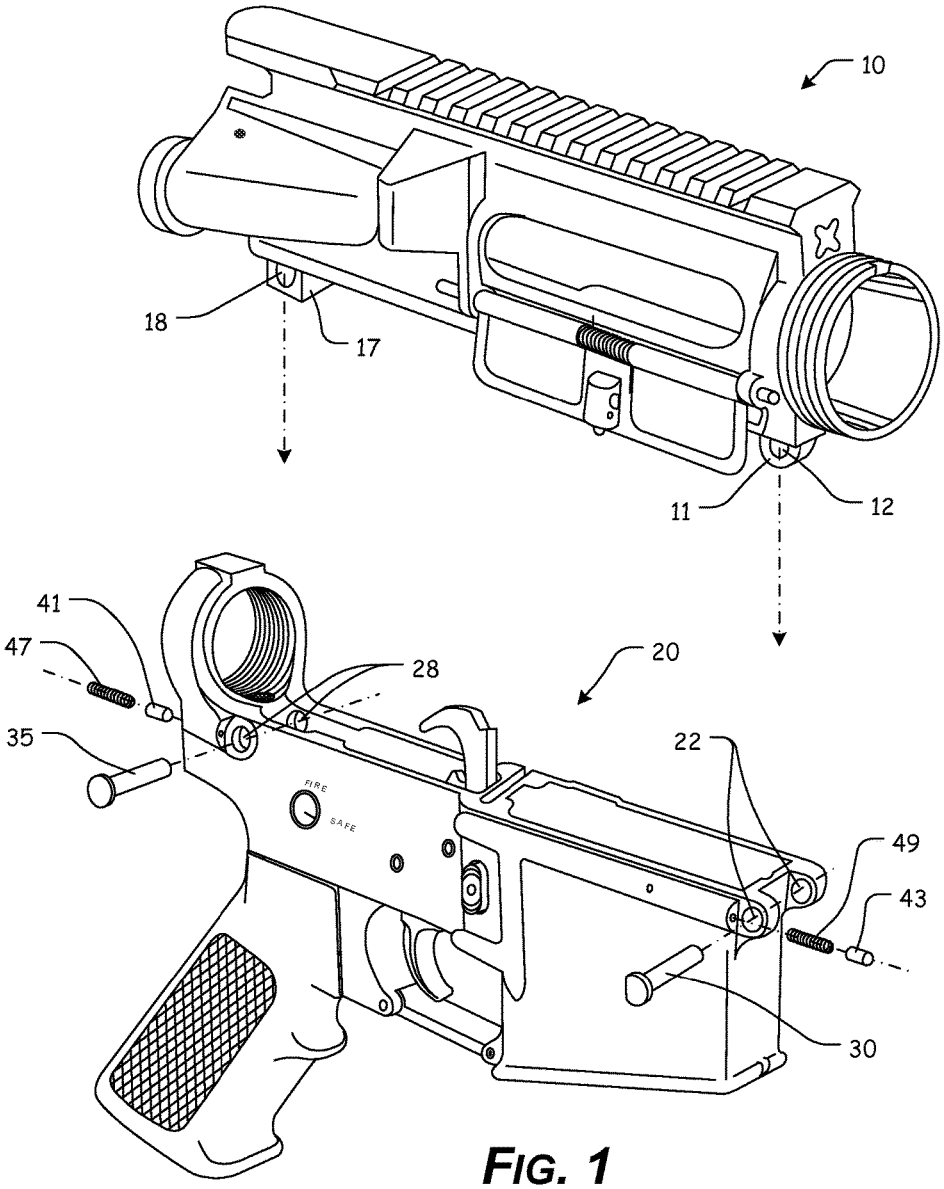
FIG. 1 PRIOR ART
FIG. 1 illustrates a perspective view of certain components of an AR-15 style upper and lower receiver.

For simplicity and clarification, the design factors and operating principles of the handguard extension component, as disclosed herein, are explained with reference to various exemplary embodiments of a handguard extension component. The basic explanation of the design factors and operating principles of the handguard extension component is applicable for the understanding, design, and operation of the handguard extension component. It should be appreciated that the handguard extension component can be adapted to many applications where a handguard extension component can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled" is defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are open-ended linking verbs. As a result, a system, device, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "handguard", "handguard extension component", and "extension portion" are used for basic explanation and understanding of the operation of the systems, methods, and apparatuses of this invention. Therefore, the terms "handguard", "handguard extension component", and "extension portion" are not to be construed as limiting the systems, methods, and apparatuses of this invention. Thus, for example, the term "handguard" is to be understood to broadly include any object or portion of material capable of having a "handguard extension component" attached or coupled thereto and the term "handguard extension component" is to be understood to broadly include any elongate portion of material capable of being attached or coupled to an object.

For simplicity and clarification, the handguard extension component of this invention will be described as being used in conjunction with an exemplary handguard attached or coupled to an upper receiver of a firearm, such as a rifle or carbine. However, it should be appreciated that these are merely exemplary embodiments of the handguard extension component and are not to be construed as limiting this invention.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Figure 2:
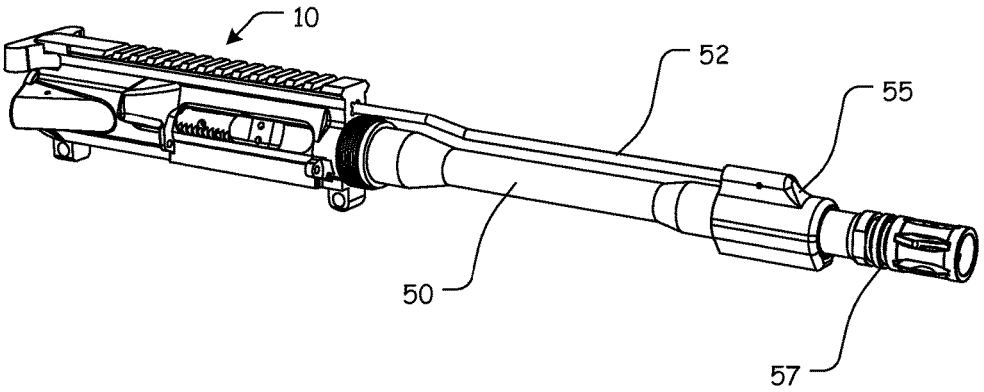
FIG. 2 PRIOR ART
FIG. 2 illustrates a perspective view of certain components of an AR-15 style upper receiver.
Figure 3:
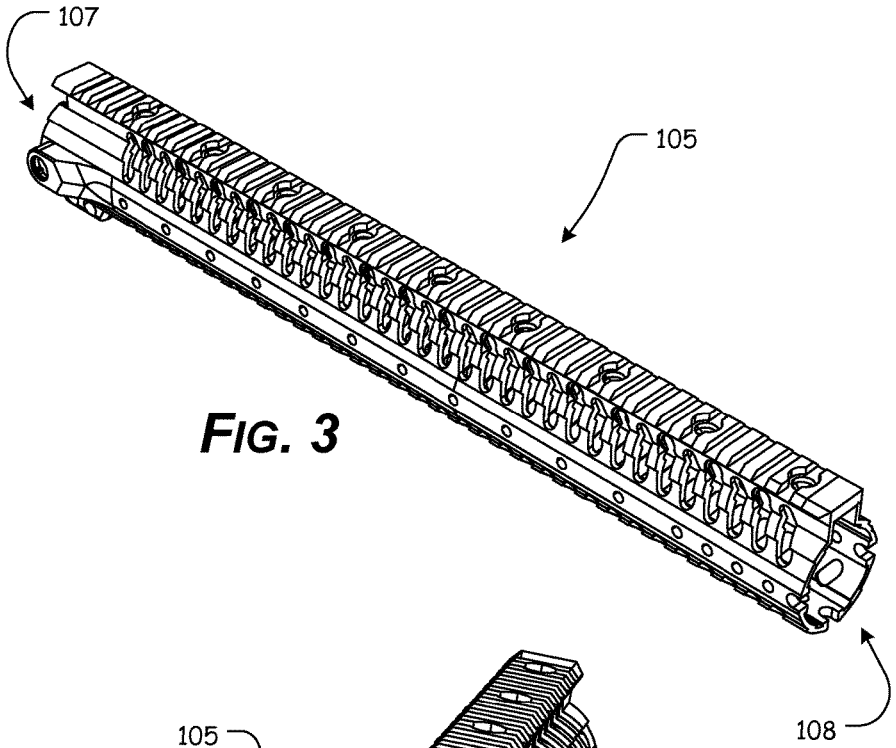
FIG. 3 illustrates a front perspective view of an exemplary embodiment of a handguard that may optionally be utilized with a handguard extension component, as disclosed herein.
Figure 4:
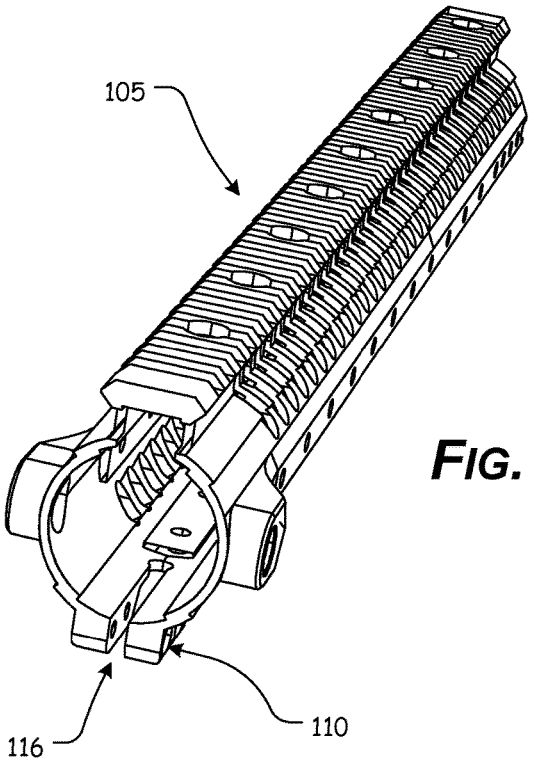
FIG. 4 illustrates a rear perspective view of an exemplary embodiment of a handguard that may optionally be utilized with a handguard extension component, as disclosed herein.
Figure 5:
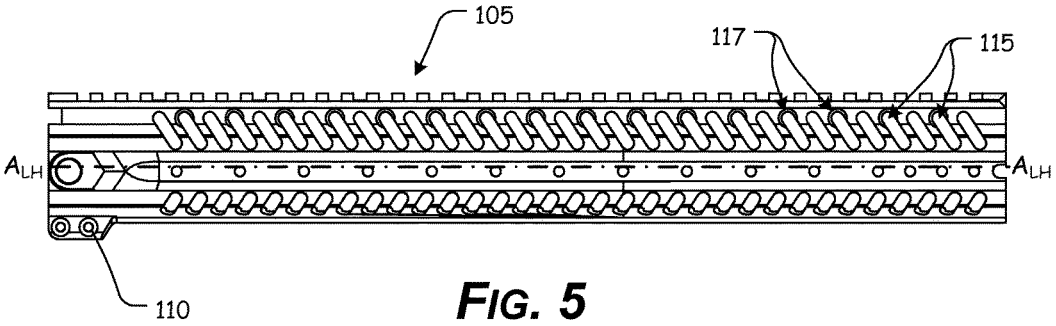
FIG. 5 illustrates a right side view of an exemplary embodiment of a handguard that may optionally be utilized with a handguard extension component (the left side view being a mirror image thereof), as disclosed herein.
Figure 6:
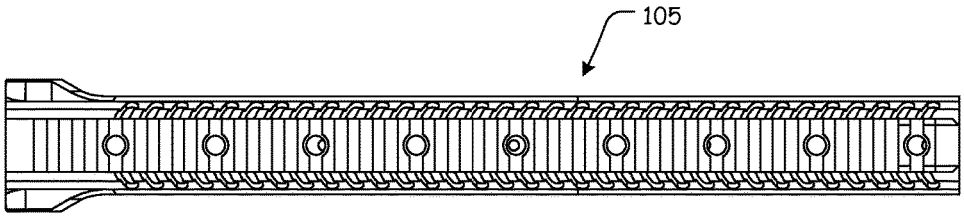
FIG. 6 illustrates a top view of an exemplary embodiment of a handguard that may optionally be utilized with a handguard extension component, as disclosed herein.
Figure 7:
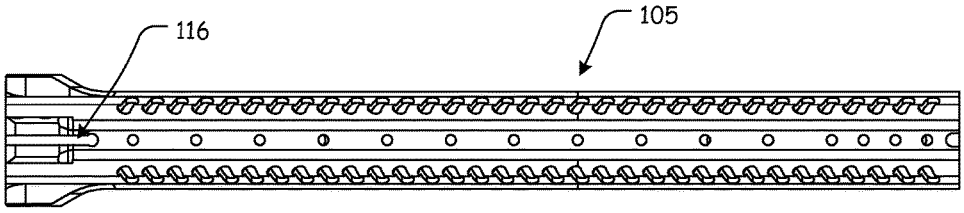
FIG. 7 illustrates a bottom view of an exemplary embodiment of a handguard that may optionally be utilized with a handguard extension component, as disclosed herein.
Figure 8:
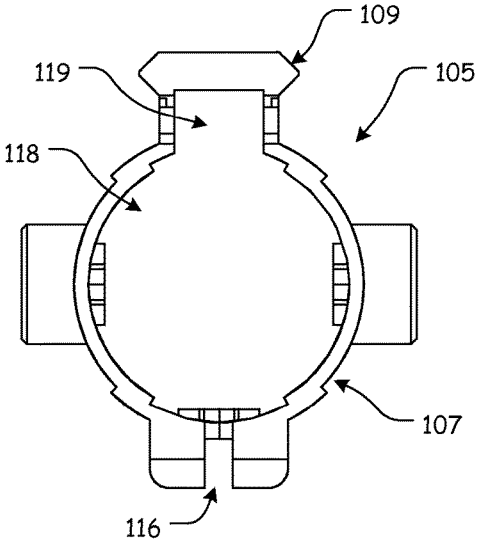
FIG. 8 illustrates a rear view of an exemplary embodiment of a handguard that may optionally be utilized with a handguard extension component, as disclosed herein.
Figure 9:
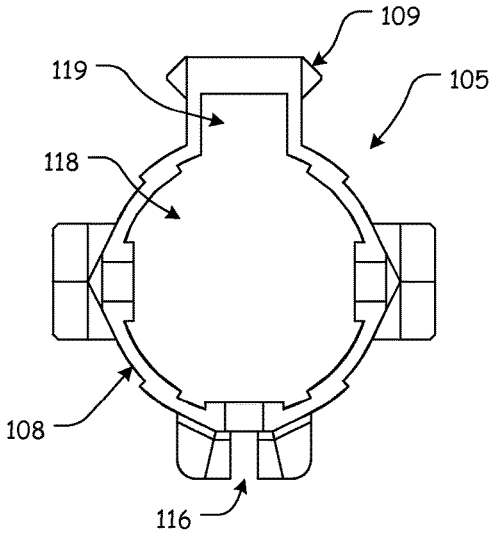
FIG. 9 illustrates a front view of an exemplary embodiment of a handguard that may optionally be utilized with a handguard extension component, as disclosed herein.

Turning now to the drawing FIGS., FIG. 1 illustrates certain elements and/or aspects of a known, exemplary AR-15 upper receiver 10 being attached or coupled to an exemplary AR-15 lower receiver 20, while FIG. 2 illustrates certain components of an assembled upper receiver 10.

Generally, the upper receiver 10 includes an upper pivot pin lug 11 having an upper pivot pin aperture 12 and an upper take-down lug 17 having an upper take-down lug aperture 18. The lower receiver 20 includes cutouts, recesses, or areas for receiving the lugs 11 and 17 so that the upper pivot pin aperture 12 can be aligned with the lower pivot pin apertures 22 and the upper take-down lug aperture 18 can be aligned with the lower take-down lug apertures 28.

The receiver pivot pin 30 is usually maintained within at least one of the lower pivot pin apertures 22 via engagement of a detent pin 43 within a slot of the pivot pin 30. A detent pin spring 49 provides a spring biasing force that urges the detent pin 43 into the slot. Once the slot is engaged by the detent pin 43, the pivot pin 30 is slidably movable between a release position and a locking position, but is maintained within at least one of the lower pivot pin apertures 22.

When the pivot pin 30 is in the release position, the shank portion of the pivot pin 30 is outside of the cutout between the lower pivot pin apertures 22, sufficient to allow the upper pivot pin lug 11 to be positioned within or removed from the cutout between the lower pivot pin apertures 22. Alternatively, when the pivot pin 30 is in the locking position, at least a portion of the shank portion is positioned within each of the lower pivot pin apertures 22.

Detents are formed so as to be engaged by the detent pin 43 at the release position and the locking position. In this manner, additional frictional engagement is provided between the detent pin 43 and the pivot pin 30 to further secure the pivot pin 30 in the release position or the locking position.

Similarly, the receiver take-down pin 35 is usually maintained within at least one of the lower take-down pin apertures 28 via engagement of a detent pin 41 within a take-down pin slot of the take-down pin 35. A detent pin spring 47 provides a spring biasing force that urges the detent pin 41 into the take-down pin slot. Once the take-down pin slot is engaged by the detent pin 41, the take-down pin 35 is slidably movable between a release position and a locking position, but is maintained within at least one of the lower take-down pin apertures 28.

When the take-down pin 35 is in the release position, the shank portion of the take-down pin is outside of the cutout or void between the lower take-down pin apertures 28, sufficient to allow the upper take-down pin lug 17 to be positioned within or removed from the cutout between the lower take-down pin apertures 28. Alternatively, when the take-down pin 35 is in the locking position, at least a portion of the shank portion is positioned within each of the lower take-down pin apertures 28.

Detents are formed so as to be engaged by the detent pin 41 at the release position and the locking position. In this manner, additional frictional engagement is provided between the detent pin 41 and the take-down pin 35 to further secure the take-down pin 35 in the release position or the locking position.

When the upper receiver 10 and the lower receiver 20 are appropriately aligned, the upper pivot pin lug aperture 12 is aligned between the lower pivot pin lug apertures 22 such that the pivot pin 30 can be slidably moved to the locking position and the upper take-down lug aperture 18 is aligned between the lower take-down lug apertures 28 such that the take-down pin 35 can be slidably moved to the locking position. Generally, attaching the upper receiver 10 to the lower receiver 20 is accomplished by first coupling or attaching, via the pivot pin 30, the upper pivot pin lug 11 to the lower receiver 20. Then, the upper receiver 10 is pivoted, via interaction between the pivot pin 30 and the upper pivot pin lug aperture 12, until the upper take-down lug aperture 18 is appropriately aligned between the lower take-down lug apertures 28 and the take-down pin 35 is slidably moved to the locking position.

As illustrated in FIG. 2, a barrel 50 is aligned with and inserted into the upper receiver 10. A gas tube 52 extends between the upper receiver 10 and a gas block 55. A flash hider 57 or some other flash suppressor or muzzle brake is typically secured to the barrel 50.

While not illustrated in FIG. 2, the barrel 50 is typically secured to the upper receiver 10 via interaction of a threaded portion of the upper receiver 10 and an internal a threaded barrel nut.

It should also be appreciated that a more detailed explanation of the components of the upper receiver 10, lower receiver 20, and barrel 50, instructions regarding how to attach and remove the upper receiver 10, the lower receiver 20, and/or the barrel 50, and certain other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the method as described.

FIGS. 3-9 illustrate certain elements and/or aspects of an exemplary embodiment of a handguard 105 that may optionally be used with the handguard extension component 160, as disclosed herein. As illustrated, the handguard 105 comprises an elongate member extending along a longitudinal axis, $A_{LH}$, from a first end 107 to a second end 108.

While the handguard 105 is illustrated as being substantially tubular and having a rail segment 109 extending from an upper side of the handguard 105 and a plurality of elongate apertures formed at spaced apart locations along the longitudinal axis or length of the handguard 105, it should be appreciated that the overall shape and appearance of the handguard 105 is a design choice based upon the desired appearance and/or functionality of the handguard 105. For example, the handguard 105 may optionally comprise a substantially cylindrical tube, without any protruding rail segment. Alternatively, the handguard the handguard 105 may optionally comprise a number of rail segments protruding from various locations along the handguard 105.

A handguard aperture 118 extends through at least a portion of the handguard 105, substantially along the longitudinal axis, ASH, of the handguard 105.

Figure 11:
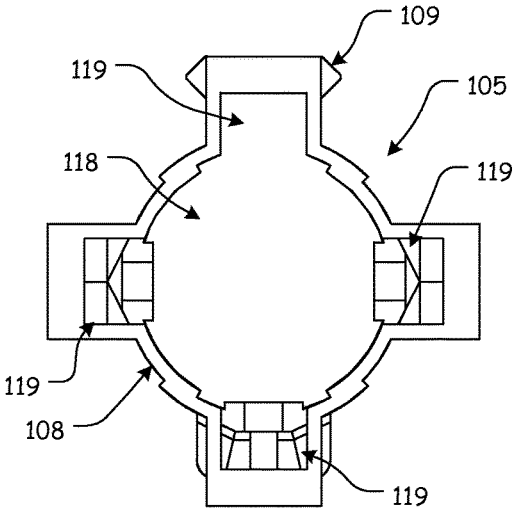
FIG. 11 illustrates a front view of yet another exemplary embodiment of a handguard that may optionally be utilized with a handguard extension component, as disclosed herein.

A handguard extension receiving channel 119 is formed in a portion of the handguard 105. In various exemplary, nonlimiting embodiments, the handguard extension receiving channel 119 extends from the handguard aperture 118. Alternatively, the handguard extension receiving channel 119 may comprise a separate channel that is separate and distinct from the handguard aperture 118. Additionally, while a single handguard extension receiving channel 119 is illustrated as being located in an upper portion of the handguard 105, proximate a 12 o'clock position, it should be appreciated that this is merely illustrative and not limiting the number or position of handguard extension receiving channels 119, as disclosed herein. For example, as illustrated in FIG. 11, two or more handguard extension receiving channels 119 may be formed in a portion of the handguard 105. In addition, the one or more handguard extension receiving channels 119 may be formed at various positions or locations about the handguard 105. Thus, it should be appreciated that one or more extension receiving channels 119 may be formed at any location in any position relative to the handguard 105.

Figure 10:
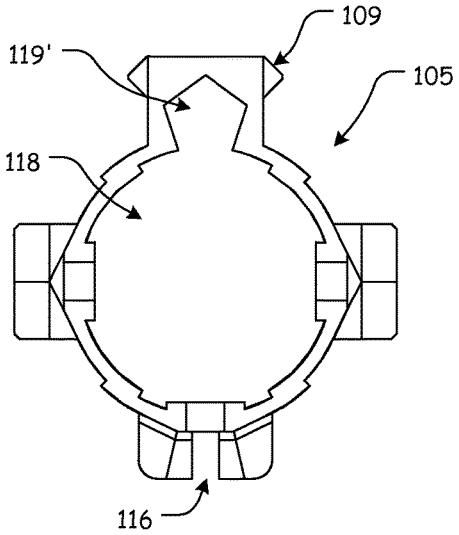
FIG. 10 illustrates a front view of another exemplary embodiment of a handguard that may optionally be utilized with a handguard extension component, as disclosed herein.

As illustrated in FIGS. 3-9, the handguard extension receiving channel 119 comprises a substantially square or rectangular profile. However, the overall profile of the handguard extension receiving channel 119 is not so limited and, as illustrated in FIG. 10, the handguard extension receiving channel 119 may comprise any desired profile, such as, for example, a substantially circular, elliptical, square, rectangular, triangular, pentangonal (as illustrated by the substantially pentagonal handguard extension receiving channel 119'), hexagonal, star, or other desired profile. Therefore, the overall size and shape of the handguard extension receiving channel 119 is a design choice based upon the desired size and shape of the handguard extension receiving channel 119 (and a corresponding, mating portion of the attachment portion 162).

One or more alignment/retention slots 115 are provided at spaced apart locations along the handguard extension receiving channel 119. In certain exemplary embodiments wherein each alignment/retention slot 115 is formed on either side of the alignment/retention slot 115, opposing alignment/retention slots 115 are formed so as to be aligned with one another. Alternatively, opposing alignment/retention slots 115 may be formed so as not to align with one another. In other exemplary embodiments, the one or more alignment/retention slots 115 are only provided on one side of the handguard extension receiving channel 119.

In exemplary embodiments wherein aligned alignment/retention slots 115 are formed on either side of the handguard extension receiving channel 119, the one or more alignment/retention slots 115 are shaped so as to allow one or more attachment screws 155 to be used to secure at least a portion of the attachment portion 162 of the handguard extension component 160 within the handguard 105.

In certain exemplary embodiments, the attachment screws 155 may be attached on either side of the handguard extension receiving channel 119 and the handguard extension component 160. Alternatively, the attachment screws 155 may optionally be sized such that a single attachment screw 155 may be utilized within each alignment/retention slot 115.

In certain exemplary embodiments, countersunk areas 117 are provided within at least a portion of each alignment/retention slot 115. If included, the countersunk areas 117 allow screwheads of the attachment screws 155 to be at least partially countersunk within the handguard 105. The countersunk areas 117 may optionally be countersunk such that a head of the attachment screws 155 is substantially flush or below a surrounding surface of the handguard 105. The countersunk areas 117 may optionally be countersunk such that the head of the attachment screw is further secured within the alignment/retention slot 115.

Figure 12:
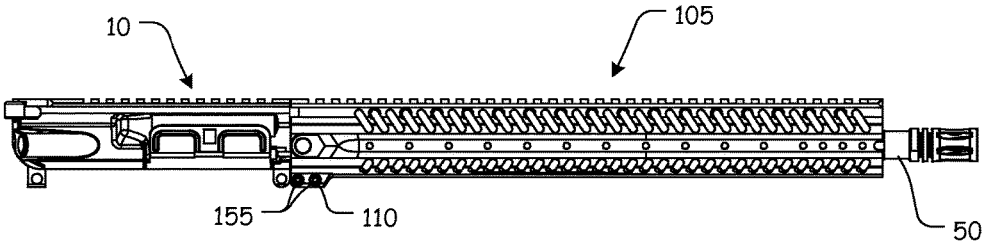
FIG. 12 illustrates a right side view of an exemplary embodiment of a handguard attached or coupled to an exemplary upper receiver that may optionally be utilized with a handguard extension component, as disclosed herein.
Figure 13:
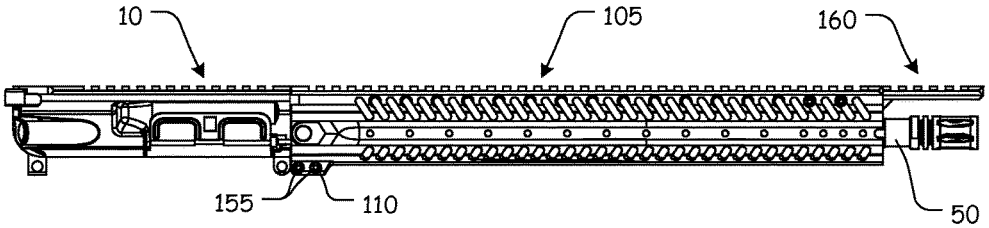
FIG. 13 illustrates a right side view of an exemplary embodiment of a handguard attached or coupled to an exemplary upper receiver, with an installed exemplary handguard extension component, as disclosed herein.
Figure 14:
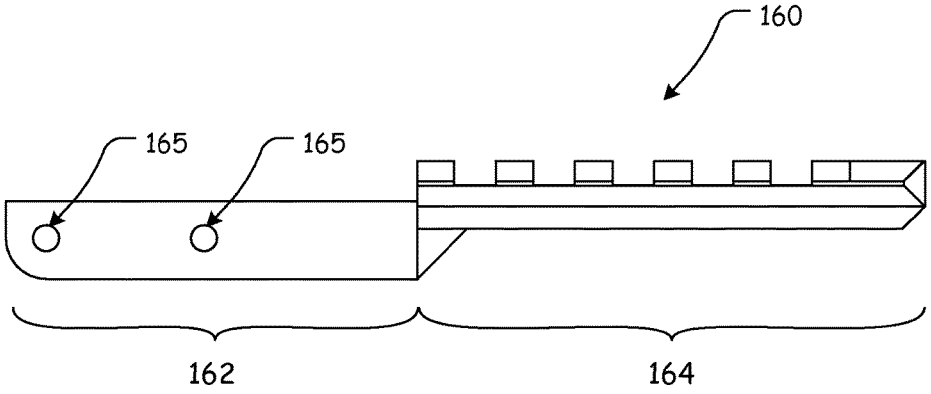
FIG. 14 illustrates a right side view of an exemplary embodiment of a handguard extension component (the right side view being a mirror image thereof), as disclosed herein.
Figure 15:
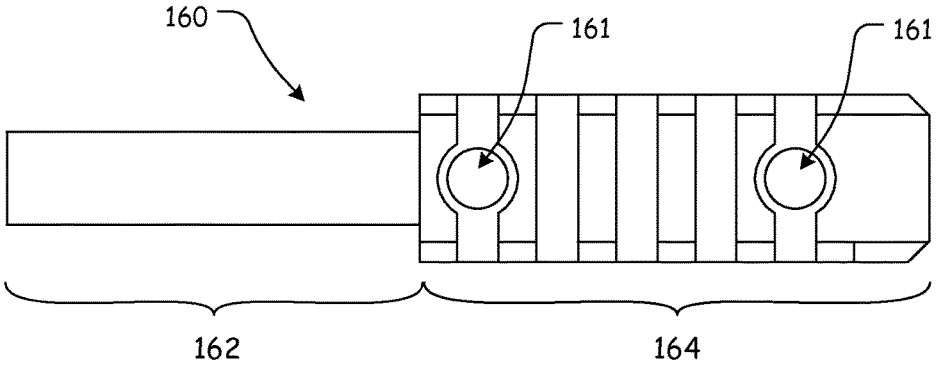
FIG. 15 illustrates a top view of an exemplary embodiment of a handguard extension component, as disclosed herein.
Figure 16:
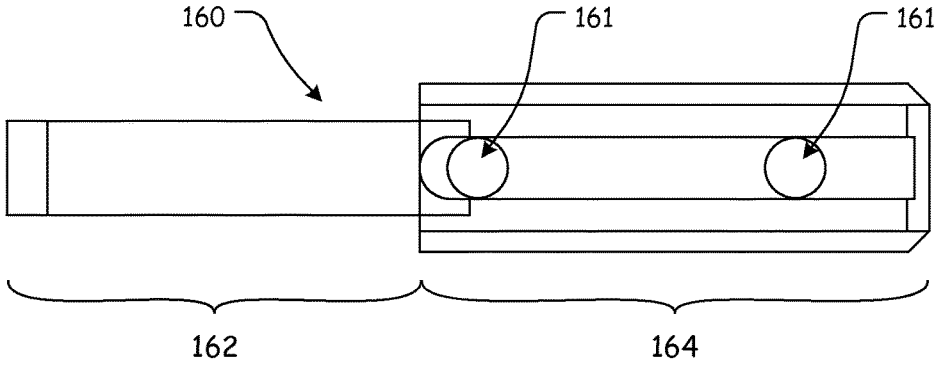
FIG. 16 illustrates a bottom view of an exemplary embodiment of a handguard extension component, as disclosed herein.
Figure 17:
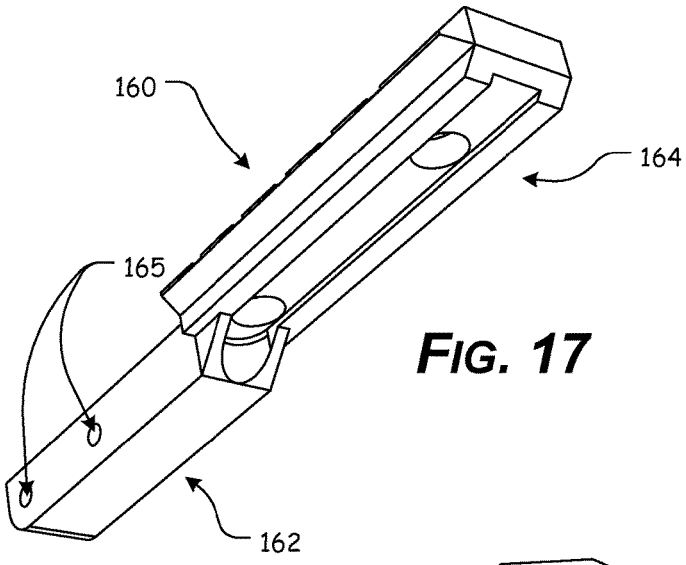
FIG. 17 illustrates a lower, rear perspective view of an exemplary embodiment of a handguard extension component, as disclosed herein.
Figure 18:
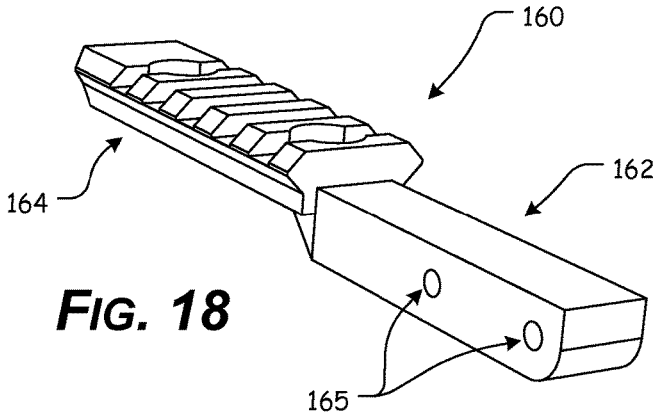
FIG. 18 illustrates an upper, rear perspective view of an exemplary embodiment of a handguard extension component, as disclosed herein.
Figure 19:
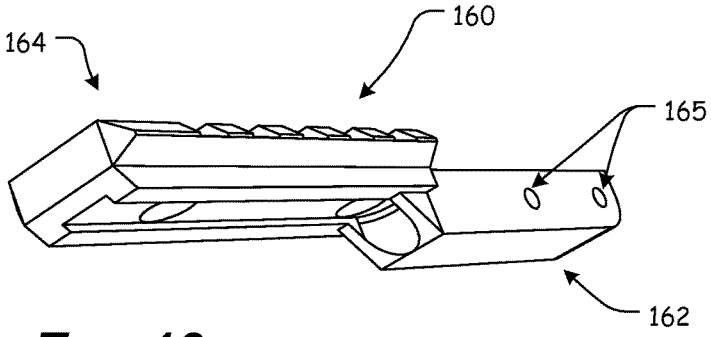
FIG. 19 illustrates a front, left side, lower perspective view of an exemplary embodiment of a handguard extension component, as disclosed herein.
Figure 20:
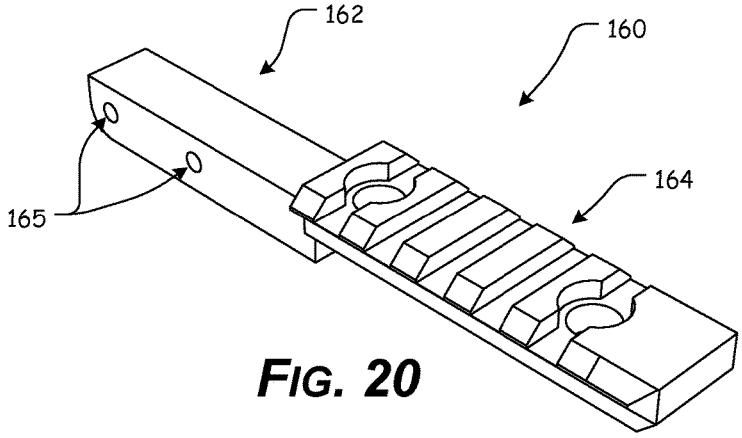
FIG. 20 illustrates a front, right side, upper perspective view of an exemplary embodiment of a handguard extension component, as disclosed herein.
Figure 21:
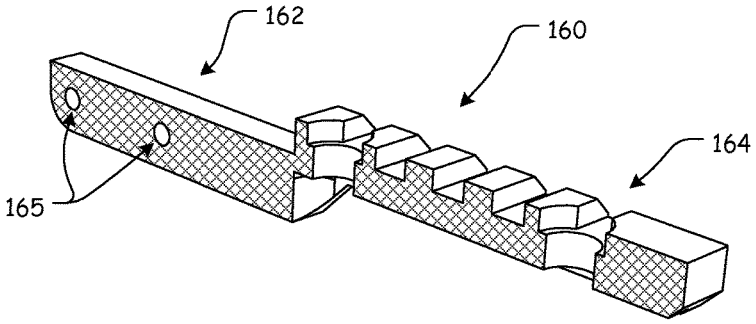
FIG. 21 illustrates a cross-sectional perspective view of an exemplary embodiment of a handguard extension component, as disclosed herein, wherein the cross section is taken along the longitudinal axis of the handguard extension component.
Figure 22:
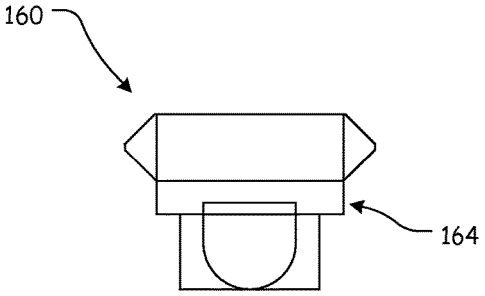
FIG. 22 illustrates a front view of an exemplary embodiment of a handguard extension component, as disclosed herein.
Figure 23:
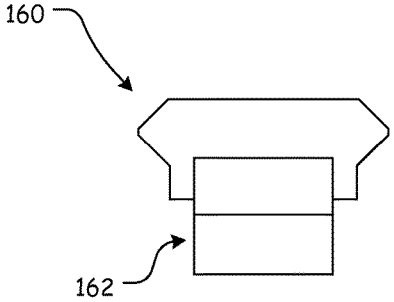
FIG. 23 illustrates a rear view of an exemplary embodiment of a handguard extension component, as disclosed herein.

FIG. 12 illustrates a right side view of an exemplary embodiment of the handguard 105, as disclosed herein, attached or coupled to an exemplary upper receiver 10, while FIG. 13 illustrates a right side view of the exemplary embodiment of a handguard 105 attached or coupled to the exemplary upper receiver 10, with an installed exemplary handguard extension component 160.

FIGS. 14-23 illustrate certain elements and/or aspects of an exemplary embodiment of a handguard extension component 160. As illustrated in FIGS. 14-23, the handguard extension component 160 comprises at least some of an attachment portion 162 and an extension portion 164.

The attachment portion 162 is sized so as to be received within at least a portion of a handguard extension receiving channel 119 of a handguard, such as, for example, handguard 105, and be retained in a desired position by interaction of alignment/retention slots 115, attachment screws 155, and one or more apertures 165. Thus, as illustrated, the attachment portion 162 comprises a substantially rectangular portion. However, it should be appreciated that the overall size and shape of the attachment portion 162 is designed so as to correspond to a handguard extension receiving channel 119, as described herein. Therefore, the overall size and shape of the attachment portion 162 is a design choice based upon the desired shape of the handguard extension receiving channel 119 and the attachment portion 162.

One or more apertures 165 are formed at least partially within or completely through the attachment portion 162. The one or more apertures 165 are provided so as to correspond to one or more alignment/retention slots 115, thereby allowing attachment screws 155 to be aligned with and passed through aligned apertures 165 and alignment/retention slots 115 to secure at least a portion of the attachment portion 162 within handguard extension receiving channel 119.

In certain exemplary embodiments, the one or more apertures 165 is at least partially internally threaded so as to interact with external threads of attachment screws 155.

The extension portion 164 extends from the attachment portion 162. In certain exemplary embodiments, a top surface of the extension portion 164 is coplanar with a top surface of the attachment portion 162. Alternatively, the top surfaces of the extension portion 164 and the attachment portion 162 are at different levels. In these exemplary embodiments, when the extension portion 164 is secured within a handguard extension receiving channel 119, a top surface of the extension portion 164 may optionally be coplanar with a top surface of a rail segment 109 extending from the handguard 105. Alternatively, a top surface of the extension portion 164 may optionally extend above or be below a top surface of the rail segment 109.

In various exemplary, nonlimiting embodiments, the extension portion 164 comprises a portion of Picatinny or other accessory rail. Alternatively, the extension portion 164 may comprise one or more apertures (such as, for example, apertures 161) or other components or surface preparations usable to attach or affix elements, objects, or devices to the extension portion 164. In certain exemplary embodiments, the extension portion 164 may also provide different lengths and heights of rail segment to allow accessories to be mounted or attached to the handguard extension component 160.

In various exemplary embodiments, the handguard extension component 160 is substantially rigid and is formed of metal. Alternate materials of construction of the handguard extension component 160 may include one or more of the following: wood, steel, stainless steel, aluminum, titanium, and/or other metals, as well as various alloys and composites thereof, plastic, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the handguard extension component 160 is a design choice based on the desired appearance and functionality of the handguard extension component 160.

It should be appreciated that certain elements of the handguard extension component 160 (such as, for example, the attachment portion 162 and the extension portion 164) may be formed as an integral unit. Alternatively, suitable materials can be used and sections or elements (such as, for example, the attachment portion 162 and the extension portion 164) made independently and attached or coupled together, such as by adhesives, welding, screws, rivets, pins, or other fasteners, to form the various elements of the handguard extension component 160.

It should also be understood that the overall size and shape of the handguard extension component 160, and the various portions thereof, is a design choice based upon the desired functionality and/or appearance of the handguard extension component 160. Thus, the handguard extension component 160 can come in a variety of shapes and sizes. It should be appreciated that the overall size and shape of the handguard extension component 160 is a design choice based upon the desired use and functionality of the handguard extension component 160.

Using the principles of the present invention, the overall size, shape, and dimensions of the handguard extension component 160 can be varied to produce, for example, a comparatively larger handguard extension component 160 or a comparatively smaller handguard extension component 160. It should be understood and appreciated that the overall size, shape, and dimensions of a handguard extension component according to this invention can be based upon a desired size and shape of handguard or accessory to be attached to the handguard extension component.

Figure 24:
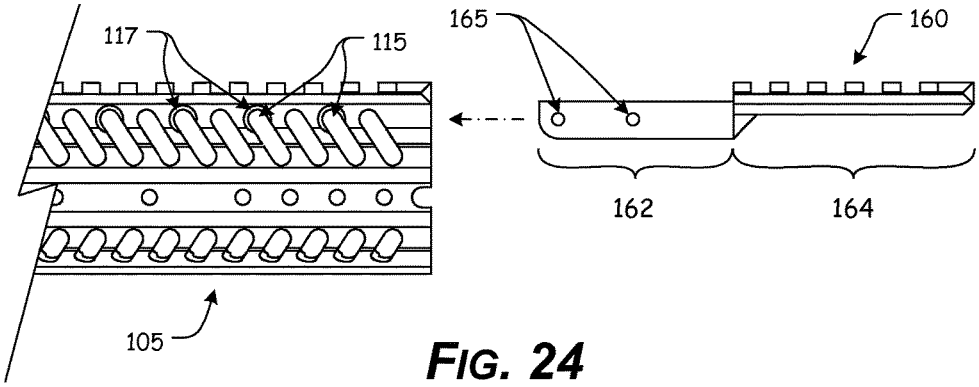
FIG. 24 illustrates a more detailed, right side view of an exemplary embodiment of a handguard extension component, wherein the handguard is being initially attached or coupled to an exemplary handguard, as disclosed herein.
Figure 25:
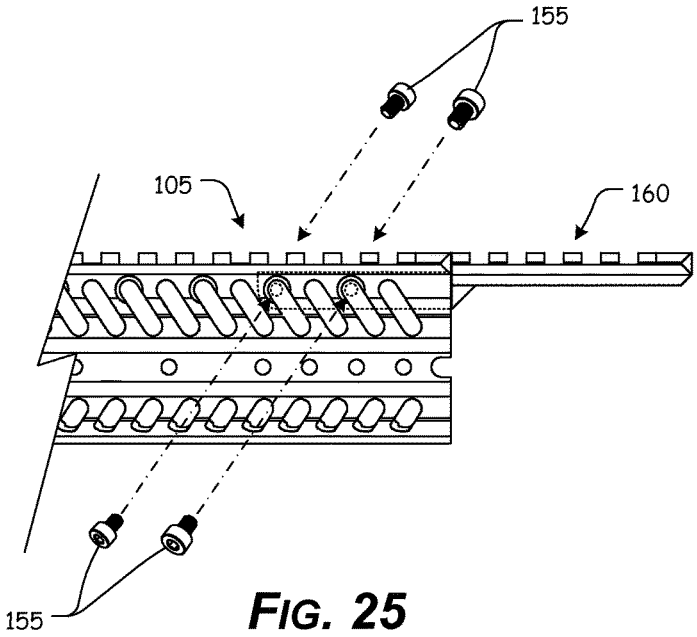
FIG. 25 illustrates a more detailed, right side view of an exemplary embodiment of a handguard extension component, wherein the handguard is being further attached or coupled to an exemplary handguard, as disclosed herein.

FIGS. 24-25 most clearly illustrate how the handguard extension component 160 is attached to an exemplary handguard 105. As illustrated in FIG. 24, during initial assembly, the handguard extension component 160 is aligned with a handguard extension receiving channel 119 and slidably inserted within the handguard extension receiving channel 119, such that at least a portion of the attachment portion 162 is seated within the handguard extension receiving channel 119.

As illustrated in FIG. 25, when the attachment portion 162 is appropriately seated within the handguard extension receiving channel 119, one or more apertures 165 are aligned with one or more alignment/retention slots 115. Once properly aligned, at least one attachment screw 155 is passed through the aligned alignment/retention slot 115 and threadedly or otherwise into the aligned aperture 165. Additional attachment screws 155 may also optionally be positioned within any additional alignment/retention slots 115 and apertures 165. The attachment screws 155 are then secured so as to appropriately secure the attachment portion 162 within the handguard extension receiving channel 119 and frictionally secure the handguard extension component 160 to the handguard 105.

When the handguard extension component 160 is attached or coupled to the handguard 105, the interaction between the attachment screws 155 and the alignment/retention slots 115 limit longitudinal movement of the handguard extension component 160 relative to the handguard 105 so that the handguard extension component 160 cannot slide forward or backward, relative to the handguard 105. If included, the countersunk areas 117 further limit movement of the attachment screws 155 and the handguard extension component 160.

While the handguard extension component has been described in conjunction with the exemplary embodiments outlined above, the foregoing description of exemplary embodiments of the handguard extension component, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the disclosed system. Any and all such changes, variations, modifications, and/or adaptations should and are intended to be comprehended within the meaning and range of equivalents of the disclosed exemplary embodiments and may be substituted without departing from the true spirit and scope of the invention.

In addition, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A handguard extension system, comprising:

a handguard extending along a longitudinal axis, from a first end portion to a second end portion, wherein said first end portion is adapted to be attached or coupled to an upper receiver, wherein a handguard aperture extends through at least a portion of said handguard, wherein at least one handguard extension receiving channel is formed in a portion of said second end portion of said handguard, wherein at least one alignment/retention slot is formed at least partially through at least one side of said handguard extension receiving channel so as to at least partially receive a portion of an attachment screw therethrough; and a handguard extension component comprising an attachment portion and an extension portion, wherein said extension portion extends from said attachment portion, wherein said attachment portion is sized so as to be at least partially received within at least a portion of said handguard extension receiving channel, wherein at least one aperture is formed through said attachment portion, wherein said at least one aperture is positioned so as to correspond to one or more of said alignment/retention slots, thereby allowing at least a portion of said attachment screw to be aligned with and passed through said aligned aperture and alignment/retention slot to secure at least a portion of said attachment portion within handguard extension receiving channel, such that when said handguard extension component is secured to said handguard, at least a portion of said extension portion of said handguard extension component extends, along said longitudinal axis, beyond said second end portion of said handguard.

2. The handguard extension system of claim 1, wherein said handguard extension receiving channel extends from said handguard aperture.

3. The handguard extension system of claim 1, wherein said handguard extension receiving channel is separated from said handguard aperture.

4. The handguard extension system of claim 1, further comprising a rail segment extending from an upper side of said handguard.

5. The handguard extension system of claim 1, further comprising one or more rail segments extending from said handguard.

6. The handguard extension system of claim 1, wherein said handguard extension receiving channel comprises a substantially circular, elliptical, square, rectangular, triangular, pentagonal, hexagonal, or star profile.

7. The handguard extension system of claim 1, wherein said at least one alignment/retention slot is formed completely through said handguard extension receiving channel.

8. The handguard extension system of claim 1, further comprising two or more alignment/retention slots formed at spaced apart locations along said handguard extension receiving channel.

9. The handguard extension system of claim 1, further comprising countersunk areas provided within at least a portion of said alignment/retention slot.

10. The handguard extension system of claim 1, wherein a profile of at least a portion of said attachment portion corresponds to a profile of said handguard extension receiving channel.

11. The handguard extension system of claim 1, wherein said at least one aperture is at least partially internally threaded.

12. The handguard extension system of claim 1, wherein a top surface of said extension portion is coplanar with a top surface of said attachment portion.

13. The handguard extension system of claim 1, wherein a top surface of said extension portion is at a different level than a top surface of said attachment portion.

14. The handguard extension system of claim 1, wherein said extension portion comprises a portion of Picatinny or accessory rail.

15. The handguard extension system of claim 1, wherein said extension portion comprises one or more apertures.

16. The handguard extension system of claim 1, wherein said attachment portion and said extension portion are formed as a monolithic unit.

17. The handguard extension system of claim 1, wherein said attachment portion and said extension portion are independent elements, attached or coupled to form said handguard extension component.

18. A handguard extension system, comprising:

a handguard extending from a first end portion to a second end portion, wherein said first end portion is adapted to be attached or coupled to an upper receiver, wherein a handguard aperture extends through at least a portion of said second end portion of said handguard, wherein at least one handguard extension receiving channel is formed in a portion of said handguard; and a handguard extension component comprising an attachment portion and an extension portion, wherein said extension portion extends from said attachment portion, wherein said attachment portion is sized so as to be at least partially received within at least a portion of said handguard extension receiving channel, and wherein at least a portion of said extension portion of said handguard extension component is sized or shaped such that at least a portion of said extension portion cannot be received within at least a portion of said handguard extension receiving channel, such that when said handguard extension component is secured to said handguard, at least a portion of said extension portion of said handguard extension component extends, along said longitudinal axis, beyond said second end portion of said handguard.

19. A handguard extension component, comprising:

an attachment portion, wherein said attachment portion is sized so as to be at least partially received within at least a portion of a handguard extension receiving channel of a second end portion of a handguard, wherein a first end portion is adapted to be attached or coupled to an upper receiver, wherein at least one aperture is formed through at least a portion of said attachment portion, wherein said at least one aperture is positioned so as to correspond to one or more alignment/retention slots formed about said handguard extension receiving channel, thereby allowing at least a portion of an attachment screw to be aligned with and passed through said aligned aperture and alignment/retention slot to secure at least a portion of said attachment portion within handguard extension receiving channel; and an extension portion, wherein said extension portion extends from said attachment portion and wherein at least a portion of said extension portion is sized or shaped such that at least a portion of said extension portion cannot be received within at least a portion of said handguard extension receiving channel, such that when said handguard extension component is secured to said handguard, at least a portion of said extension portion of said handguard extension component extends, along a longitudinal axis of said handguard, beyond said second end portion of said handguard.

20. The handguard extension component of claim 19, wherein said extension portion comprises a portion of Picatinny or accessory rail.

* * * * *